United States Patent [19]

Piech von Planta et al.

[11] Patent Number: 4,794,652

[45] Date of Patent: Jan. 3, 1989

[54] SAFETY HELMET

[75] Inventors: Corina Piech von Planta, Gähkopf 30, 7000 Stuttgart 1; Wolfram Schleicher, Stuttgart, both of Fed. Rep. of Germany

[73] Assignee: Corina Piech von Planta, Stuttgart, Fed. Rep. of Germany

[21] Appl. No.: 21,774

[22] Filed: Mar. 4, 1987

[30] Foreign Application Priority Data

Mar. 7, 1986 [DE] Fed. Rep. of Germany ..... 3607483

[51] Int. Cl.[4] ..... A42B 3/02; A61F 9/04

[52] U.S. Cl. ..... 2/414; 2/12; 2/424

[58] Field of Search ..... 2/9, 6, 12, 414, 424, 2/425, 427, 429

[56] References Cited

U.S. PATENT DOCUMENTS

| | | | |
|---|---|---|---|
| 1,366,907 | 2/1921 | Dunand | 2/6 |
| 2,860,343 | 11/1958 | Aileo | 2/9 |
| 2,866,978 | 1/1959 | Stuart et al. | 2/6 |
| 2,952,853 | 9/1960 | Benzel | 2/429 |
| 3,345,642 | 10/1967 | Uminski | 2/6 |
| 3,478,365 | 11/1969 | Varga | 2/424 |
| 3,721,994 | 3/1973 | DeSimone et al. | 2/6 |
| 3,806,951 | 4/1974 | Halteman | 2/6 |
| 4,462,119 | 7/1984 | Rudd | 2/424 |

FOREIGN PATENT DOCUMENTS

| | | | |
|---|---|---|---|
| 2339353 | 8/1977 | France | 2/424 |
| 2532528 | 3/1984 | France | 2/424 |

*Primary Examiner*—Wm. Carter Reynolds
*Attorney, Agent, or Firm*—Toren, McGeady & Associates

[57] ABSTRACT

A safety helmet for motorcycle drivers or the like includes a helmet shell which is open at the chin of the user and has a shock-absorbing inner lining, and a folding portion which is swivelably and removably connected to the helmet shell. The folding portion forms a chin protector composed of outer shell and inner lining and includes a visor. The chin protector rests at least in its lower portion against corresponding end faces of the helmet shell. The folding portion is held so as to be in contact with the helmet shell through holding means which are displaceable against a spring load. The folding portion extends at least essentially over the forward half of the helmet and is hinged to the helmet shell so as to be releaseable only in a predetermined swivel position. The visor is hinged to the inside of the folding portion which extends over the front half of the helmet.

20 Claims, 5 Drawing Sheets

SAFETY HELMET

BACKGROUND OF THE INVENTION

1. Field of the Invention

The present invention relates to safety helmets. The invention relates particularly to a safety helmet for motorcycle drivers or the like, including a helmet shell which is open at the chin of the user and has a shock-absorbing inner lining, and a folding portion which is swivably and removably connected to the helmet shell. The folding portion forms a chin protector composed of outer shell and inner lining and includes a visor and any other devices usually arranged in the chin area of a helmet, such as, ventilating devices.

2. Description of the Prior Art

One type of safety helmets known in the prior art are so-called integrated safety helmets. In the integrated safety helmets, a chin protector is formed in one part with the helmet shell. A cutout formed in the helmet shell essentially extending around the face of the user of the helmet is covered by a removable or replaceable shield which has swivelably connected thereto a visor of transparent plastics material. Integrated safety helmets of this type have, as has been recognized early, a number of disadvantages. One disadvantage is that placing the helmet over the head of the user is uncomfortable. More importantly, another disadvantage resides in the fact that the helmet is difficult to remove, particularly after an accident.

These disadvantages of so-called integrated safety helmets described above are avoided in a safety helmet disclosed in German Pat. No. 28 46 636. This safety helmet includes a folding portion which essentially covers the entire front opening of the helmet shell. The folding portion overlaps the edges of the helmet shell in the upper and side portions thereof to a greater or lesser extent. The folding portion has in the region of the chin a shock-absorbing inner lining. A free space remaining between the folding portion and the helmet shell in front of the face of the user of the helmet can be opened or closed as desired by means of a visor of transparent plastics material which is hinged to the helmet shell. The visor can be opened, for example, in order to improve the fresh air supply to the user of the helmet. Safety helmets of this type provide the same protective effect of that of an integrated safety helmet, while they avoid their most significant disadvantages.

However, since in safety helmets of this type the swivelable visor is hinged to the helmet shell and surrounds the outside of the helmet shell, this type of helmet has the disadvantage that, when the helmet is worn during driving and the visor is opened, a substantial accumulation of air occurs between the visor and the face of the helmet user, and also between the visor and the helmet shell. This type of safety helmet has the further disadvantage that the visor which consists of transparent and, thus easily scratchable plastics material, is always located on the outer side of the helmet and will be scratched prematurely and, therefore, its transparency will be reduced.

In addition, it must be possible for a helmet user to wear the helmet without any chin protector at all. In this case, the user of the helmet is not worse off with respect to any possible danger of injury than if a helmet is worn with its chin protector and visor being swivelled upwardly.

It is, therefore, the primary object of the present invention to improve a safety helmet whose front opening of the helmet shell is covered by a swivelable folding portion, so that the folding portion covering the front opening cannot be released unintentionally while, on the other hand, the folding portion can be removed quickly when desired.

It is another object of the invention to provide a visor arranged in such a way that no increased accumulation of air at the helmet occurs when the visor is opened.

It is another object of the invention to provide a visor arranged in such a way that no increased accumulation of air at the helmet occurs when the visor is opened.

It is another object of the present invention to provide a visor which can be swivelled into a protected position when the helmet is not worn.

Finally, it is an object of the present invention to provide a helmet which can be worn without a chin protector, but with other devices which are advantageous particularly during the summer.

SUMMARY OF THE INVENTION

In accordance with the present invention, the safety helmet described above includes a folding portion with a chin protector which, when in the operative position, rests at least in its lower portion against the corresponding end faces of the helmet shell. The folding portion is held so as to be in contact with the helmet shell through holding means which are displaceable against a spring load. The folding portion extends at least essentially over the forward half of the helmet and is hinged to the helmet shell so as to be releasable only in a predetermined swivel position. The visor is hinged to the inside of the folding portion which extends over the front half of the helmet.

Since, in accordance with the invention, the folding portion extends over the forward half of the helmet, the folding portion can be hinged to the helmet by means of a bayonet-type joint which makes it possible that the folding portion can be released from the helmet shell in a predetermined position quickly and without the aid of additional means or tools. Moreover, the fact that the folding portion extends over the forward part of the helmet ensures that the visor can be arranged or hinged to the inside of the folding portion, so that, when the visor is opened, no accumulation of air can occur at the helmet. Furthermore, when the helmet is not in use, the visor can be swivelled into a protected position inside the helmet, so that the visor cannot be scratched when the helmet is not used.

In accordance with a preferred embodiment of the invention, the bayonet-type joint between the folding portion and the helmet shell makes possible a release of the folding portion when it is swivelled by more than 90° in the direction of opening of the folding portion. The bayonet-type joint preferably includes two projections or pins arranged on a common axis opposite to each other and fastened, for example, to the folding portion. The projections or pins have at their free ends radially extending projections. The bayonet-type joint further includes bushings arranged in the same common axis arranged, for example, in the helmet shell. The bushings have recesses extending radially relative to a central bore. The radially extending projections on the projections or pins are flange-type projections. Due to the fact that the folding portion is hinged to the helmet shell in such a way that the foldig portion can be released from the helmet shell only when swivelled about more than 90°, preferably about 110°, relative to its normal position of use in which it is folded down, it is completely impossible that the connection between the folding portion and the helmet shell can be unintentionally released due to any impact or pushing loads occurring during an accident.

On the other hand, the bayonet-type joint ensures that the folding portion can always be removed from the helmet shell without requiring any auxiliary means or particularly tools, even when impacts have occurred on the helmet during an accident. Thus, it is ensured that the folding portion can be released from the helmet shell quickly and without the aid of the auxiliary means either by the user of the helmet himself or by another person who may be present at the scene of an accident.

The lateral and upper edge regions of the folding portion extending beyond the chin protector are constructed as a shell-shaped plastics material part and are provided at least along the edge overlapping the head part of the helmet shell with a strip-like sealing member which rests against or slides on the outer periphery of the helmet shell. Thus, draft air cannot occur within the helmet in an uncontrolled manner. It is particularly not possible that draft air may occur in the head part of the helmet shell caused by a negative pressure creating a suction of air.

When the folding portion is in its folded-down position corresponding to the position of use of the chin protector, it can be locked to the helmet in the region of its end faces resting against the helmet shell by means of swivel bolts which each engage a locking member provided on the inner side of the helmet shell. The swivel bolts are mounted so as to be swivelable about a transversely directed axis in a plane extending parallel to the outer contour of chin protector and helmet shell at the inner side of the outer shell of the chin protector. The swivel bolts extend with a grip or actuating member over an indentation of the lower transverse edge of the chin protector. Accordingly, the conventional locking between helmet shell and chin protector or folding portion formed by a pressure member directed transversely of the plane of the helmet shell or the skin protector is no longer used and, therefore, any possibly still existing remaining risks of an unintentional release of the locking connection between the helmet shell and the folding portion due to impact stresses during an accident are eliminated.

The locking between the folding portion and the helmet shell may be effected by swivel bolts which are segment-shaped or angular flat material pieces or flat-shaped pieces and have cutouts which are also segment-shaped or triangular. A loading spring acting in locking direction supported by the outer shell of the chin protector acts on one of the inner faces of the cutouts. Thus, the swivel bolts are continuously maintained in engagement with the corresponding locking member at the helmet shell by means of the spring force. The loading spring may be a helical spring which acts on the swivel bolt and is supported by the chin protector. The spring may also be a spring plate, particularly a stirrup-shaped spring plate, which is formed in one piece with the swivel bolt. The spring plate formed in one piece with the swivel bolt has the advantage that the safety helmet can be produced with lower costs, particularly when the swivel bolt is constructed as a plastics material-shaped piece.

Compared to the conventional connection effected by a pressure member directed transversely to the plane of the helmet shell and the chin protector, the locking connection between the helmet shell and the folding portion in accordance with the present invention formed by swivel bolts provides not only the advantage of increased safety in the case of an accident, but also the advantage of an ergonomically more advantageous construction, because the disengagement of the swivel bolts can be effected by a movement which is directed in the same direction as the movement of folding up the folding portion. Thus, the manipulation of the safety helmet by the user is significantly improved.

In order to ensure that the folded-up folding portions rest as closely as possible against the helmet shell, it is provided in accordance with invention that the inner lining of the helmet shell protrudes beyond the edges of the outer shell in the region of the front opening, particularly in the jaw area of the helmet shell. When the chin protector is in its position of use, i.e., when the folding portion is folded down, the end faces of the protruding inner lining rest against corresponding end faces of the inner lining of the chin protector, wherein the inner lining of the folding part in the region of the chin protector is recessed relative to the lateral edges of the outer shell.

A visor of transparent plastics material closes or opens a cutout provided in the folding portion for the visor. Advantageously, the visor is mounted on the folding portion so as to be swivelable within the folding portion and, thus, within the helmet contour about a swivel axis arranged at a distance from the swivel axis of the folding portion. As a result, the visor is located within the helmet contour even in the open state, so that no accumulation of air can be generated at the helmet even in the opened state of the visor. In addition, when the helmet is not in use, the visor can be swivelled into its position located within the helmet contour, so that it cannot be scratched.

Conventional locking means may be provided on the inside of the outer shell of the folding portion for interacting with the visor in order to lock the visor in any desired position. Moreover, the lower edge of the visor opening of the folding portion may have a groove formed therein for receiving the lower edge of the visor. The groove may preferably include a sealing insert. Along the upper edge of the swivelable visor is advantageously placed a strip of sealing material with which the visor rests against the inner side of the outer shell of the folding portion, so that the visor is always spaced apart from the outer shell of the folding portion during swivelling. Thus, scratching of the visor during opening and closing can be prevented.

In accordance with another embodiment of the present invention, the folding portion of the safety helmet is replaced by a forwardly projecting peak, as in a peaked hat. The peak can be releasably connected to the helmet shell by means of a support arm and by means of a pin or the like. For securing the support of the peak, it is further provided that the peak rests against the edges of the helmet shell in the lower jaw region by means of a support member connected at an angle to the support arm.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DETAILED DESCRIPTION OF THE INVENTION

Figure 1:
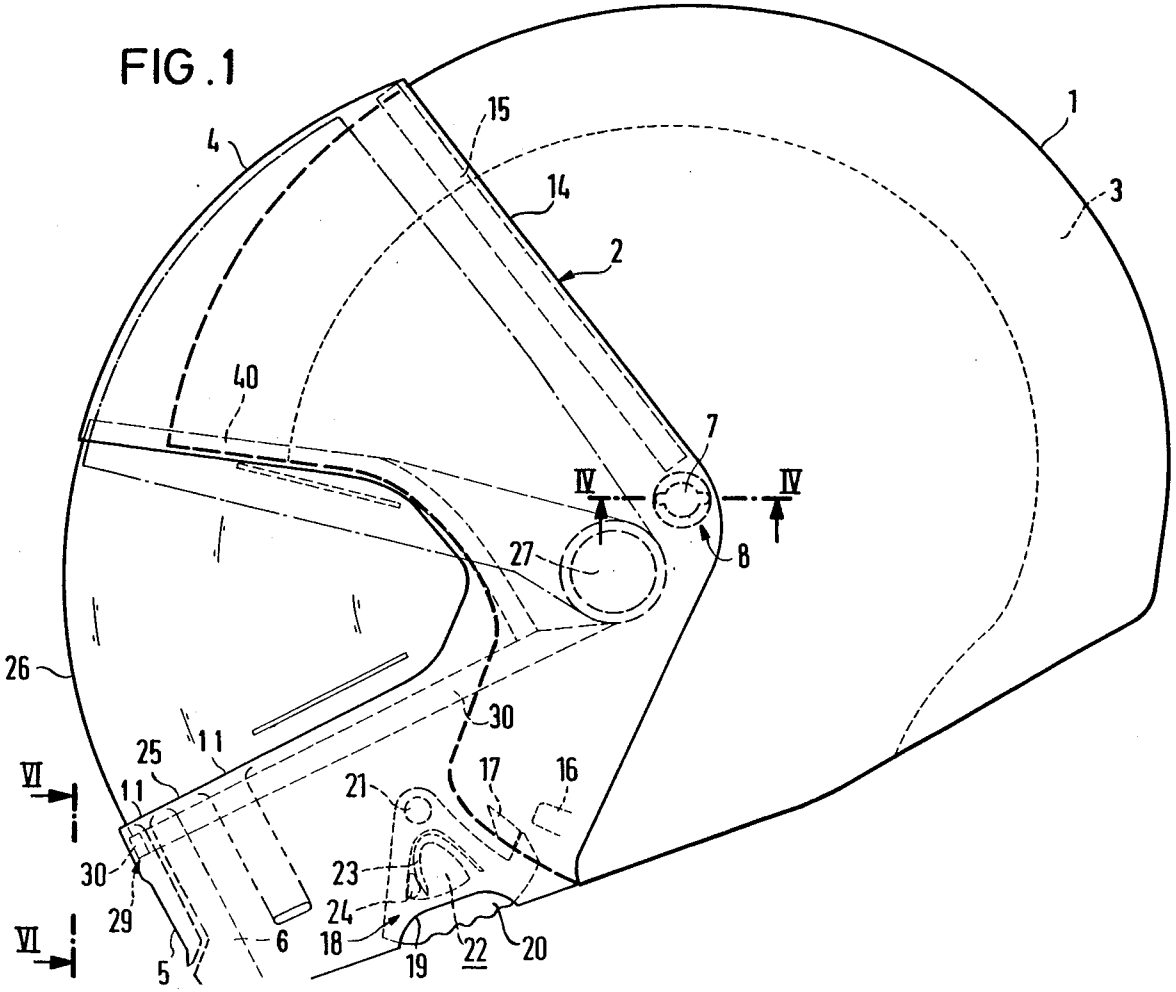
FIG. 1 is a partially broken side view of a safety helmet according to the present invention, with folded-down folding portions.

The safety helmet illustrated in FIGS. 1 to 6 of the drawing includes an outer shell 1 and a folding portion 2 which is swivelably and releasably hinged to the outer shell 1. Helmet shell 1 is constructed in one piece and has on its inside a shock-absorbing internal lining 3, not illustrated in detail in the drawing. Folding portion 2 is composed essentially of the shell-like outer shell 4 of plastics material and, in the region of its chin protector 5, is also provided with a shock-absorbing internal lining 6. In addition, ventilating ducts 11 are defined in the region of chin protector 5 of folding portion 2.

As can be seen particularly in FIG. 1, folding portion 2 extends essentially over the front half of the entire helmet and is releasably hinged to the helmet shell 1 so as to be swivelable about an axis 7 located in the region of or above the eye line of the helmet user.

Folding portion 2 is hinged to the helmet shell 1 by means of a bayonet-type joint 8 which, in turn, in the illustrated embodiment includes two pins 9 fastened opposite each other and inwardly facing to the outer shell 4 of folding portion 2. At their free ends, pins 9 have two oppositely located, radially directed flanges 10. Bushings provided in the helmet shell 1 have a central bore 12 and radially directed recesses 13 formed in central bore 12. As can be seen particularly from FIG. 1, the alignment of the radial flanges 10 of pins 9 relative to the outer contour of the folding portion 2 and the alignment of the radial recesses 13 mean that the folding portion 2 can be removed from the helmet shell 1 exclusively in a position in which the folding portion 2 is swung about 110° in opening direction, while the swivelable connection between folding portion 2 and helmet shell 1 remains effective in all other swivel angle positions of folding portion 2.

Along its upper edge 14 extending across the head part of the helmet shell 1, folding portion 2 has a strip-like sealing member 15 which rests against and slides on the surface of helmet shell 1. In its lower region, particularly in the area of the chin protector, folding portion 2 rests against the helmet shell 1 through edges of its outer shell 4 or special support projection 16. For maintaining a contact between the edges of folding portion 2 in the region of the chin protector and the corresponding edges of helmet shell 1 or the special support projection 16 mounted on the helmet shell 1, swivelable bolts 18 are provided which engage a locking member 17 provided on the inside of helmet shells 1 and releasable against the force of a loading spring. Swivel bolt 18 is made of a segment-shaped flat material or a flat-shaped part and has at its bottom side a gripping or actuating part 20 which engages in an upwardly direction indentation 19 at the lower edge of the folding portion 2.

Figure 1A:
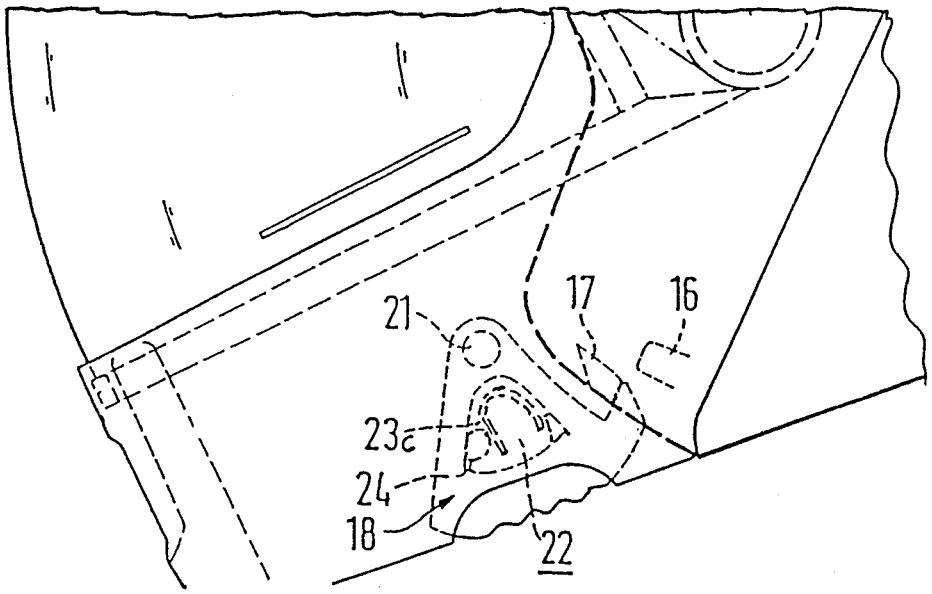
FIGS. 1*a* and 1*b* show, on a larger scale, details of specific features of the safety helmet of FIG. 1.
Figure 1B:
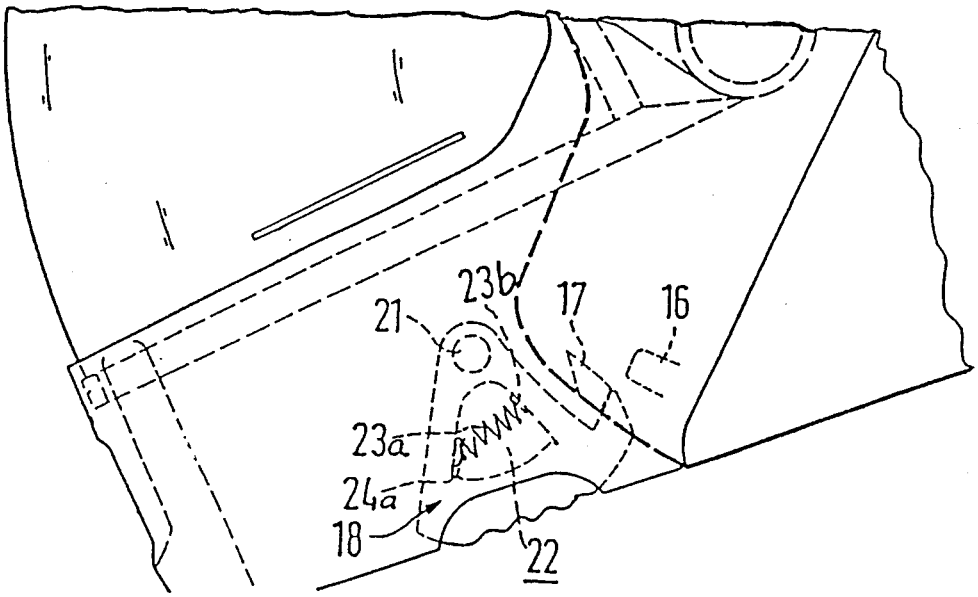

The swivel bolts 18 formed of flat material or flat-shaped parts are mounted on the outer shell 4 of folding portions 2 opposite the gripping or actuating part 20 so as to be swivelable about a transversely extending axis 21. In their middle region, swivel bolts 18 have an also segment-shaped cutout 22 in which is arranged a loading spring which, in the illustrated embodiment, is a stirrup-shaped spring plate 23 which, in turn, is braced against a detent 24 in the outer shell 4 of folding portion 2. As shown in FIG. 1, spring plate 23 is formed in one piece with swivel bolt 18. FIG. 1*a* shows that spring plate 23*c* may be braced against detent 24, on the one hand, and against a face defined in cutout 22, on the other hand. As illustrated in FIG. 1*b*, the loading spring may also be a helical spring 23*a*; mounted between detent 24*a* and face 23*b* defined in cutout 22.

Inside the folding portion 2 is provided a visor 26 which closes a visor opening 25 of folding portion 2. The visor 26 is made of a transparent plastics material. The visor 26 is arranged so as to be swivelable and adjustable around a swivel axis 27 located spaced from the swivel axis 7 of folding portion 2.

Outer shell 4 of folding portion 2 has a groove 29 with a sealing member 30 placed in the groove 29. Groove 29 receives the lower edge 28 of visor 26. In addition, visor 26 includes along its upper edge a sealing profile 40 of an elastic material, particularly a velvet strip. Sealing profile 40 is mounted between the outer surface of the visor 26 and the inner surface of the folding portion 2.

Figure 2:
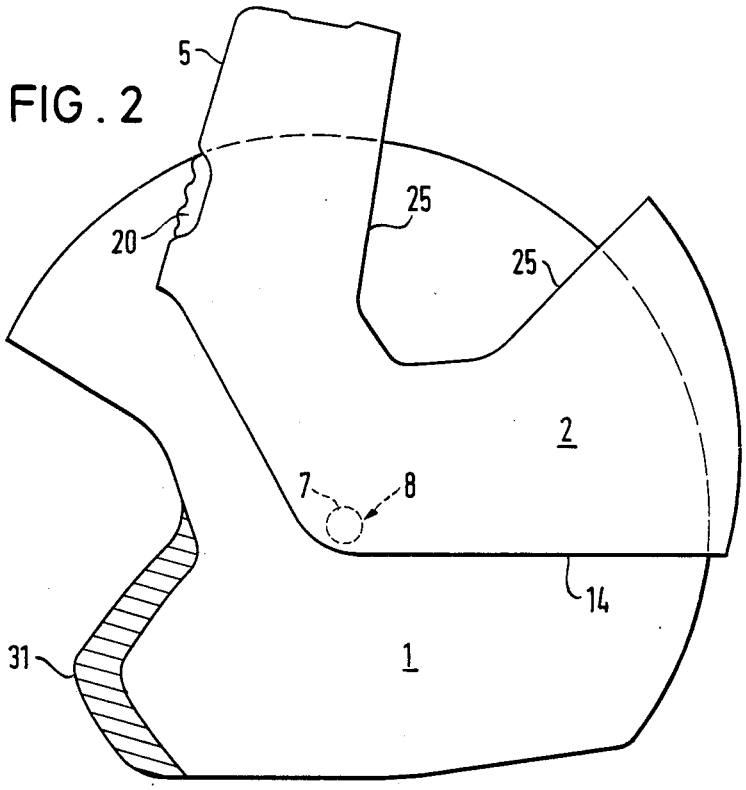
FIG. 2 is a side view of a safety helmet whose folding portion is swivelled upwardly into the position in which it can be separated from the safety helmet.

As illustrated in FIG. 2, in the jaw area of the helmet, particularly along the vertical sections of the forward opening of the helmet shell 1, internal lining 3 is formed to be projecting forwardly to correspond to the edge regions of the outer shell of helmet shell 1. The projecting portions of internal lining 3 are denoted by reference numeral 31.

Figure 7:
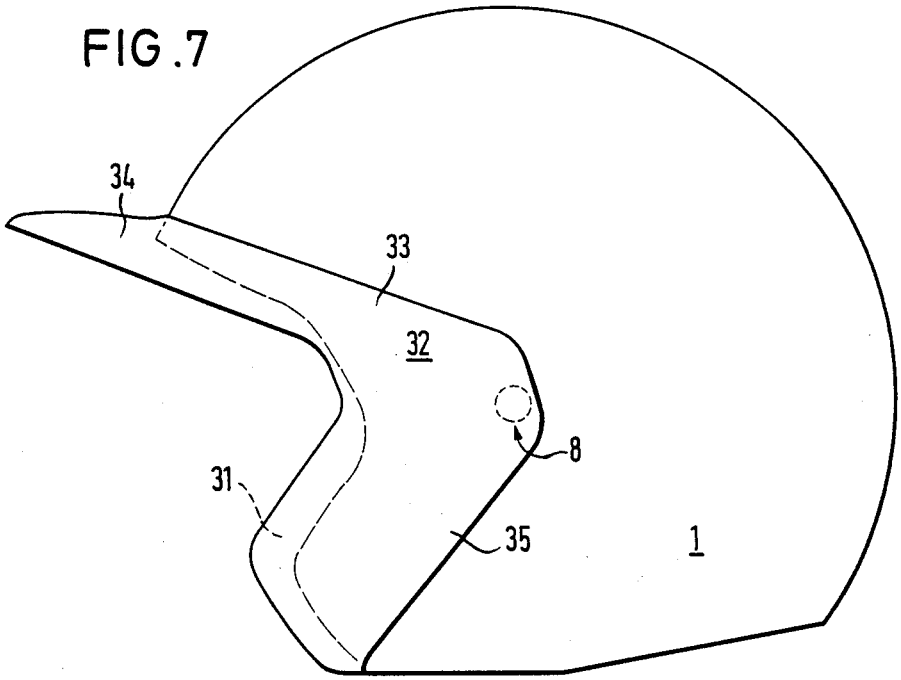
FIG. 7 is a side view of the safety helmet with a peak.
Figure 3:
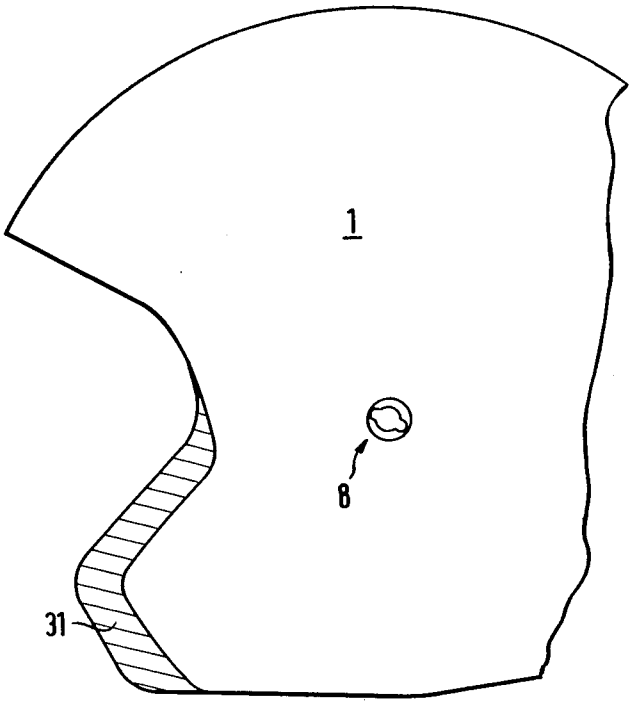
FIG. 3 is a side view of the helmet shell of the safety helmet illustrated in FIGS. 1 and 2.
Figure 5:
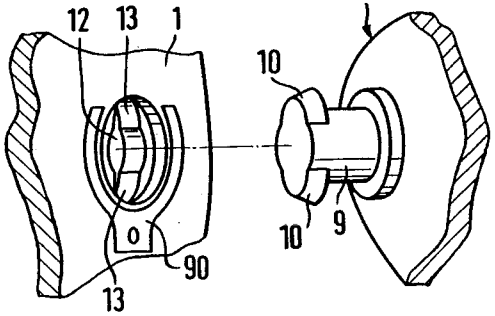
FIG. 5 is an exploded view of the detail illustrated in FIG. 4.
Figure 4:
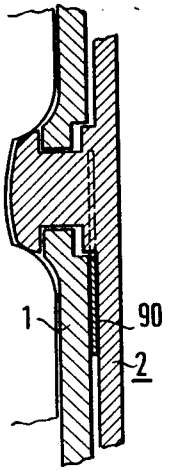
FIG. 4 is a partial sectional view of the safety helmet illustrated in FIG. 1 taken along sectional line IV—IV.
Figure 6:
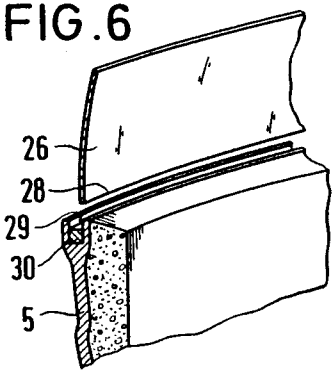
FIG. 6 is a partial sectional view of the safety helmet illustrated in FIG. 1 taken along sectional line VI—VI.

As illustrated in FIG. 7, the folding portion 2 of the helmet can also be replaced by a simple peak 32. This peak 32 is fastened to the helmet shell 1 by means of a bayonet-type joint 8. Peak 32 has a protruding portion 34 and a support arm 33 which is attached to the protruding portion 34 at an angle. Connected to the support arm 33 of peak 32, in turn, is a support member 35 through which, in the same manner as folding portion 2, peak 32 is supported in the lower region by the edges of the outer shell of helmet shell.

While specific embodiments of the invention have been shown and described in detail to illustrate the application of the inventive principles, it will be understood that the invention may be embodied otherwise without departing from such principles.

We claim:

1. A safety helmet, comprising a helmet shell which defines an opening in the area of the chin of the user of the helmet, the inner surface of the helmet shell having a shock-absorbing inner lining, a folding portion placed in front of and suitably and removably connected to the helmet shell, the folding portion forming a chin protector, the chin protector including an outer shell and an inner lining and a visor connected to the folding portion, a lower part of the folding portion resting against corresponding end faces of the helmet shell when the folding portion is in the operative position, holding means for holding the folding portion in contact with the helmet shell, the holding means being displaceable against a spring load, the folding portion extending at least essentially over the forward half of the helmet, wherein the folding portion is connected to the helmet shell so as to be releaseable therefrom in a predetermined swivel position.

2. A safety helmet, comprising a helmet shell which defines an opening in the area of the chin of the user of the helmet, the inner surface of the helmet shell having a shock-absorbing inner lining, a folding portion placed in front of and suitably and removably connected to the helmet shell, the folding portion forming a chin protector, the chin protector including an outer shell and an inner lining and a visor connected to the folding portion, a lower part of the folding portion resting against corresponding end faces of the helmet shell when the folding portion is in the operative position, holding means for holding the folding portion in contact with the helmet shell, the holding means being displaceable against a spring load, wherein the folding portion extends at least essentially over the forward half of the helmet, and wherein the folding portion defines an opening which is closed by the visor, the visor being of transparent plastics material and being mounted so as to be swivelable about an axis which is parallel to the swivel axis of the folding portion.

3. The safety helmet according to claims 1 or 2, wherein the helmet is a motorcycle helmet.

4. The safety helmet according to claims 1 or 2, wherein a ventilating means is provided in the folding portion.

5. The safety helmet according to claim 1, comprising a bayonet-type joint for connecting the folding portion to the helmet shell, wherein the bayonet-type joint permits removal of the folding portion from the helmet shell when the folding portion is swivelled more than 90° relative to its folded-down position of use.

6. The safety helmet according to claim 5, wherein the folding portion can be released from the helmet shell only when the folding position is swivelled about 110° relative to the folded-down position of use.

7. The safety helmet according to claim 5, wherein bayonet-type joints are provided on either side of the helmet the joints including pins located on a common axis opposite to each other and fastened to the folding portion, radially extending projections being provided at the free end of the pins, and bushings arranged in the helmet shell in the common axis, the bushings defining central bores with radially directed recesses defined in the bores.

8. The safety helmet according to claim 7, wherein the radially extending projections are flanges.

9. The safety helmet according to claim 1, wherein the swivel axis of the folding portion is located above the eye level of the user of the helmet.

10. The safety helmet according to claim 1, wherein the folding portion includes a shell-shaped plastics material part extending beyond the chin protector, the folding portion further comprising a strip-like sealing member attached to an edge of the folding portion extending at least across a head part of the helmet shell, the sealing member resting against and sliding on the outer circumference of the helmet shell.

11. The safety helmet according to claim 1, wherein swivel bolts are provided on the folding portion in the region where the end faces of the chin protector rests against the helmet shell, locking members which are engaged by the swivel bolt being arranged on the inner side of the helmet shell.

12. The safety helmet according to claim 11, wherein the swivel bolts are mounted so as to be swivelable about a transversely directed axis in a plane extending parallel to the outer contour of the chin protector and the helmet shell at the inner side of the outer shell of the chin protector, and wherein the swivel bolts include gripping and actuating members which extend over indentations defined in the rearward transverse edge of the chin protector.

13. The safety helmet according to claim 12, wherein the swivel bolts are segment-shaped flat material parts and define segment-shaped cutouts, a loading spring acting in locking direction against a face defined in the cutout, the loading spring being supported by the outer shell of the chin protector.

14. The safety helmet according to claim 13, wherein the loading spring is a helical spring.

15. The safety helmet according to claim 13, wherein the loading spring is a stirrup-shaped spring plate formed in one piece with the flat material part.

16. The safety helmet according to claim 1, wherein the inner lining of the helmet shell protrudes beyond the edges of the outer shell in the region of the front opening, and wherein in the folded-down position the folding portion rests with its end faces against corresponding end faces of an inner lining of the chin protector.

17. The safety helmet according to claim 16, wherein the inner lining of the folding portion in the region of the chin protector is recessed relative to the lateral edges of the outer shell.

18. The safety helmet according to claim 2, wherein the visor is mounted so as to be swivelable about a swivel axis which is spaced apart from the swivel axis of the folding portion.

19. The safety helmet according to claims 2 or 18, wherein locking means are provided on the inner side of the outer shell of the folding portion, the locking means acting on the visor.

20. The safety helmet according to claim 19, wherein the lower edge of the visor opening of the folding portion defines a groove for receiving the lower edge of the visor, a sealing insert being placed in the groove, and wherein the vizor includes at the upper edge thereof an elastic sealing material.

* * * * *